US010596841B2

(12) United States Patent
Sasaki

(10) Patent No.: US 10,596,841 B2
(45) Date of Patent: Mar. 24, 2020

(54) DROPLET DISCHARGING APPARATUS

(71) Applicant: Seiko Epson Corporation, Tokyo (JP)

(72) Inventor: Tsuneyuki Sasaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/544,831

(22) PCT Filed: Jan. 7, 2016

(86) PCT No.: PCT/JP2016/000047
§ 371 (c)(1),
(2) Date: Jul. 19, 2017

(87) PCT Pub. No.: WO2016/117286
PCT Pub. Date: Jul. 28, 2016

(65) Prior Publication Data

US 2018/0009245 A1 Jan. 11, 2018

(30) Foreign Application Priority Data

Jan. 20, 2015 (JP) ..... 2015-008687

(51) Int. Cl.
*B41J 25/00* (2006.01)
*B41J 11/00* (2006.01)
(Continued)

(52) U.S. Cl.
CPC ..... *B41J 25/006* (2013.01); *B41J 2/1714* (2013.01); *B41J 2/215* (2013.01); *B41J 2/2114* (2013.01);
(Continued)

(58) Field of Classification Search
CPC .... B41J 11/002; B41J 11/0015; B41J 29/377; B41J 2/04515; F26B 21/004
See application file for complete search history.

(56) References Cited

U.S. PATENT DOCUMENTS 5,428,384 A * 6/1995 Richtsmeier ..... B41J 2/04515 347/102
6,059,406 A * 5/2000 Richtsmeier ..... B41J 2/04515 347/102
(Continued)

FOREIGN PATENT DOCUMENTS

JP 05-262019 A 10/1993
JP 2005-161758 A 6/2005
(Continued)

OTHER PUBLICATIONS

International Search Report from PCT/JP2016/000047 dated Mar. 15, 2016, 3 pages.

*Primary Examiner* — John Zimmermann
(74) *Attorney, Agent, or Firm* — Workman Nydegger

(57) ABSTRACT

A droplet discharging apparatus (10) includes a supporting section (20) including a supporting surface (21) that supports a medium M, a first head (81) including a first nozzle that discharges first liquid onto the medium supported by the supporting surface (21), a second head (82) including a second nozzle that discharges second liquid that promotes curing of the first liquid by reacting with the first liquid onto the medium M supported by the supporting surface (21), a carriage (83) that reciprocally travels in a width direction while holding the first head (81) and the second head (82), an air sending section (70) that generates airflow in the front direction in an discharging area facing the supporting surface, and a shielding section (85) that shields the airflow in the front direction in the discharging area R1.

10 Claims, 4 Drawing Sheets

(51) Int. Cl.

| | |
|---|---|
| ***B41J 2/21*** | (2006.01) |
| ***B41J 2/215*** | (2006.01) |
| ***B41J 29/13*** | (2006.01) |
| ***B41J 2/17*** | (2006.01) |
| ***B41J 29/02*** | (2006.01) |
| ***B41J 29/377*** | (2006.01) |

(52) U.S. Cl.
CPC ..... *B41J 11/0015* (2013.01); *B41J 29/02* (2013.01); *B41J 29/13* (2013.01); *B41J 29/377* (2013.01)

(56) References Cited

U.S. PATENT DOCUMENTS 6,328,438 B1 * 12/2001 Ozawa ..... B41J 2/2114 347/95
6,367,906 B1 * 4/2002 Hiramatsu ..... B41J 2/04 347/34
7,338,146 B2 * 3/2008 Morikoshi ..... B41J 2/17513 347/29
7,594,722 B2 * 9/2009 Kadomatsu ..... B41J 2/2114 347/100
7,699,431 B2 * 4/2010 Nakazawa ..... B41J 2/1721 347/31
8,474,968 B2 * 7/2013 Yamaguchi ..... B41J 29/38 347/102
9,770,928 B2 * 9/2017 Harayama ..... B41J 29/02
2006/0274099 A1 * 12/2006 Jahana ..... B41J 2/15 347/15
2006/0284910 A1 * 12/2006 Aruga ..... B41J 2/2132 347/9
2009/0268002 A1 10/2009 Houjou
2010/0128073 A1 * 5/2010 Togawa ..... B41J 2/1714 347/8
2011/0221845 A1 * 9/2011 Ue ..... B41J 11/0085 347/104
2011/0310204 A1 * 12/2011 Ohnishi ..... B41J 2/2114 347/102
2013/0113867 A1 * 5/2013 Endo ..... B41J 11/002 347/102
2014/0152734 A1 * 6/2014 Endo ..... B41J 11/0095 347/16
2014/0302290 A1 10/2014 Takekoshi et al.
2015/0097906 A1 * 4/2015 Beier ..... B41J 2/0057 347/103
2015/0183225 A1 * 7/2015 Ishii ..... B41J 2/14233 347/93
2017/0043588 A1 2/2017 Takekoshi et al.

FOREIGN PATENT DOCUMENTS

| | | | |
|---|---|---|---|
| JP | 2005-111716 | A | 5/2007 |
| JP | 2007-125714 | A | 5/2007 |
| JP | 2007-216495 | A | 8/2007 |
| JP | 2007-230034 | A | 9/2007 |
| JP | 2009-248444 | A | 10/2009 |
| JP | 2011-121315 | A | 6/2011 |
| JP | 2012-179802 | A | 9/2012 |
| JP | 2013-116631 | A | 6/2013 |
| JP | 2013-139119 | A | 7/2013 |
| JP | 2014-083707 | A | 5/2014 |

* cited by examiner

[Fig. 1]
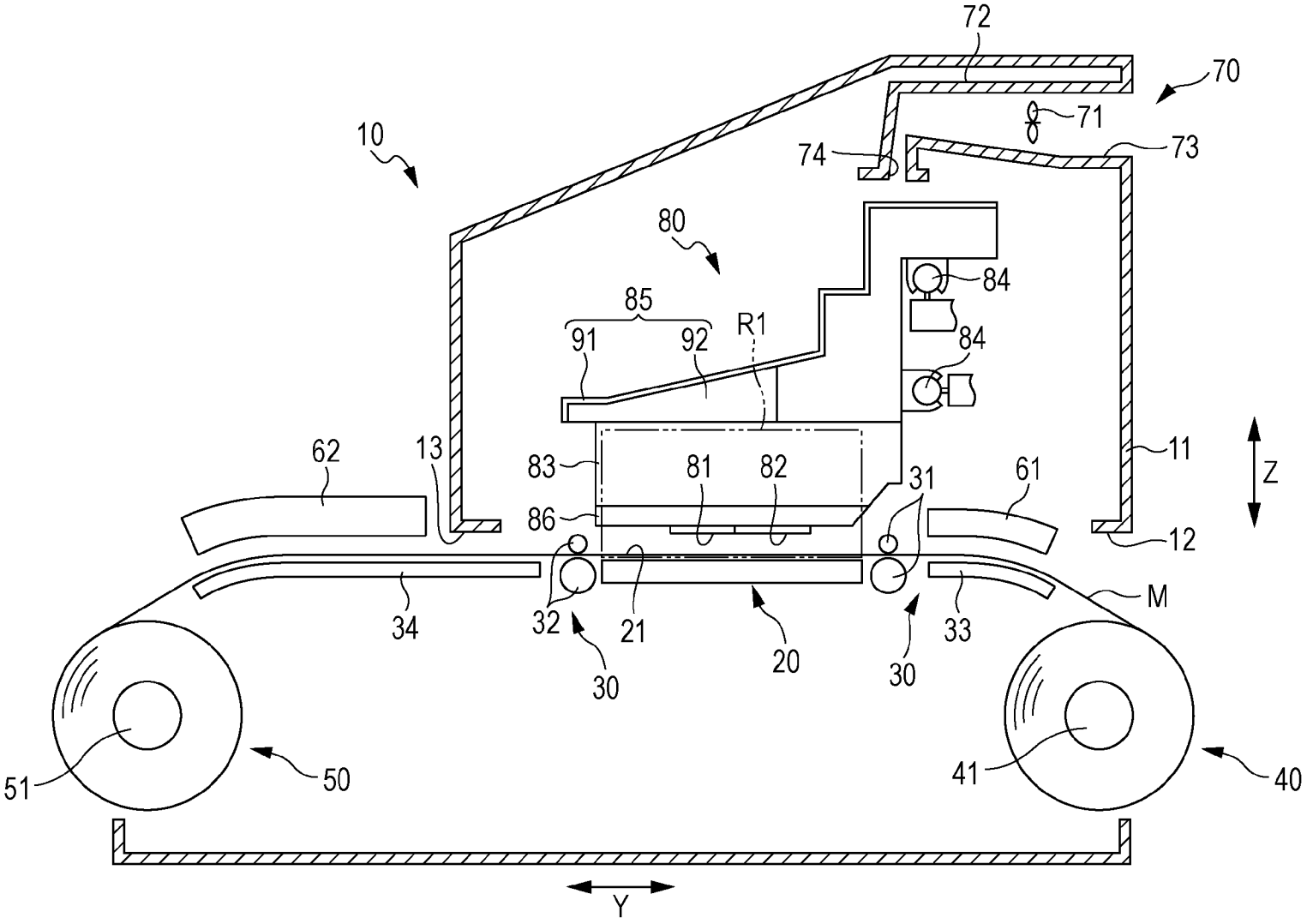

[Fig. 2]
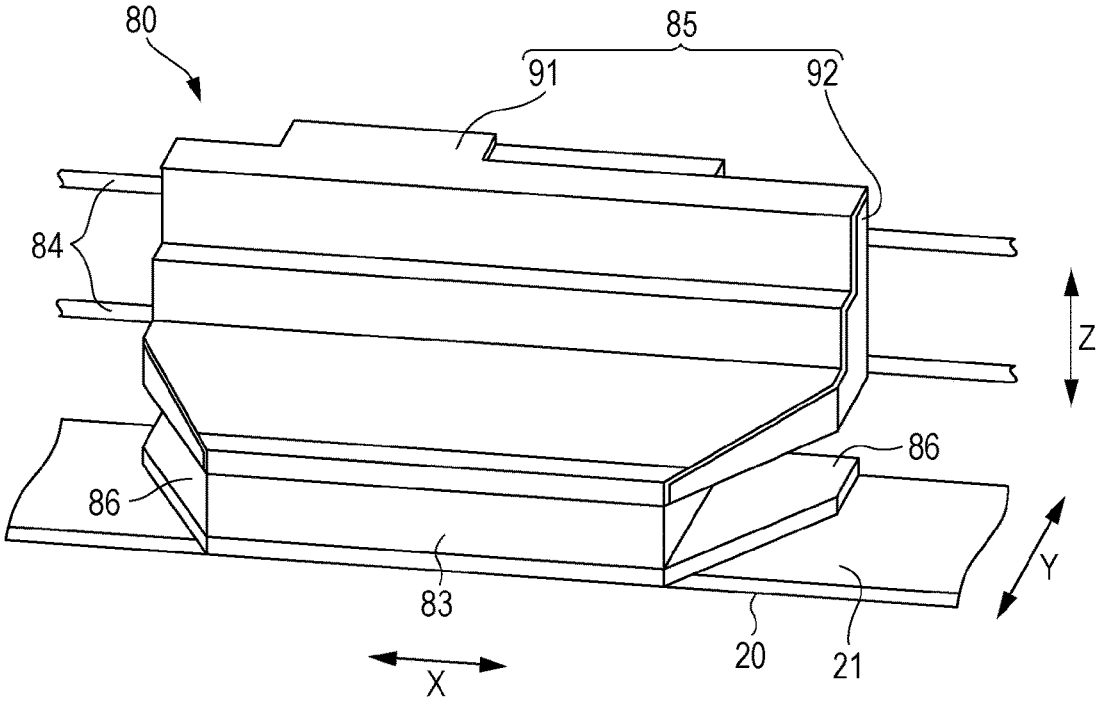
[Fig. 3]
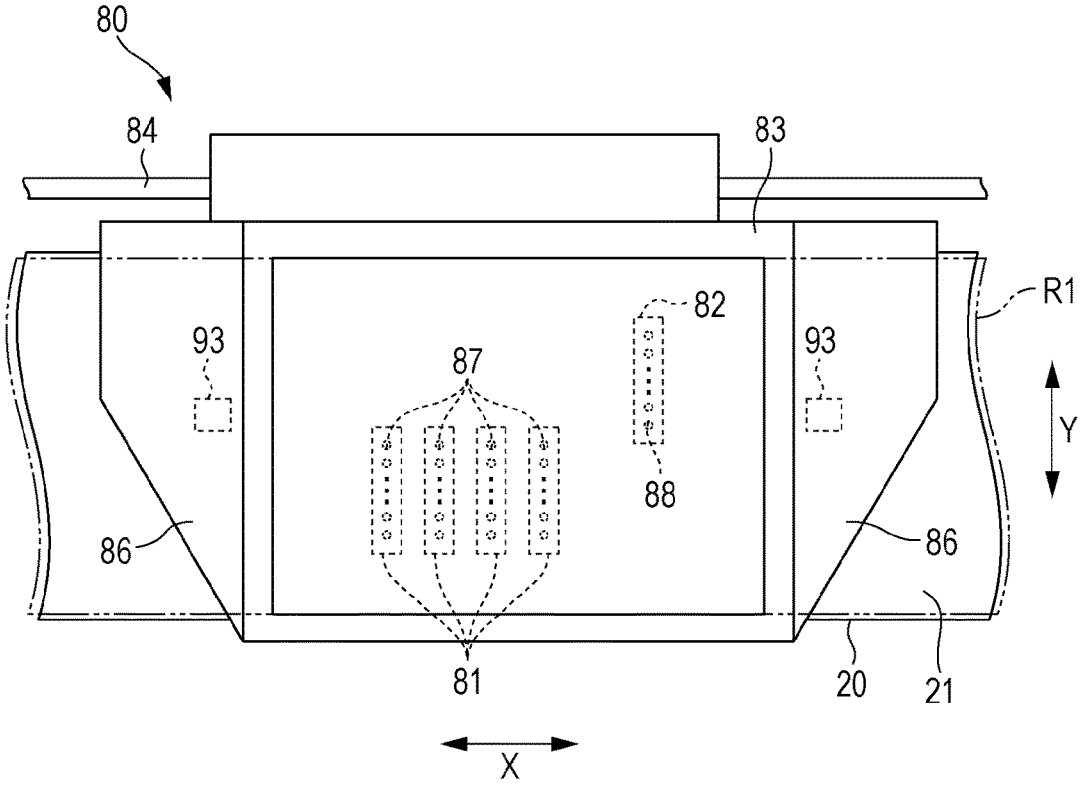

[Fig. 4]
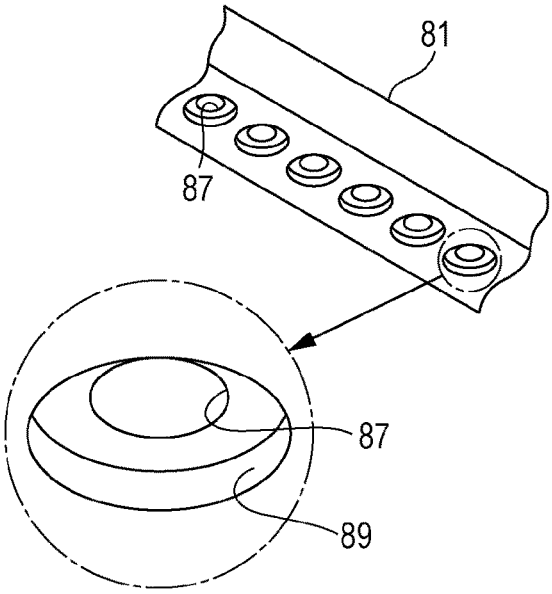
[Fig. 5]
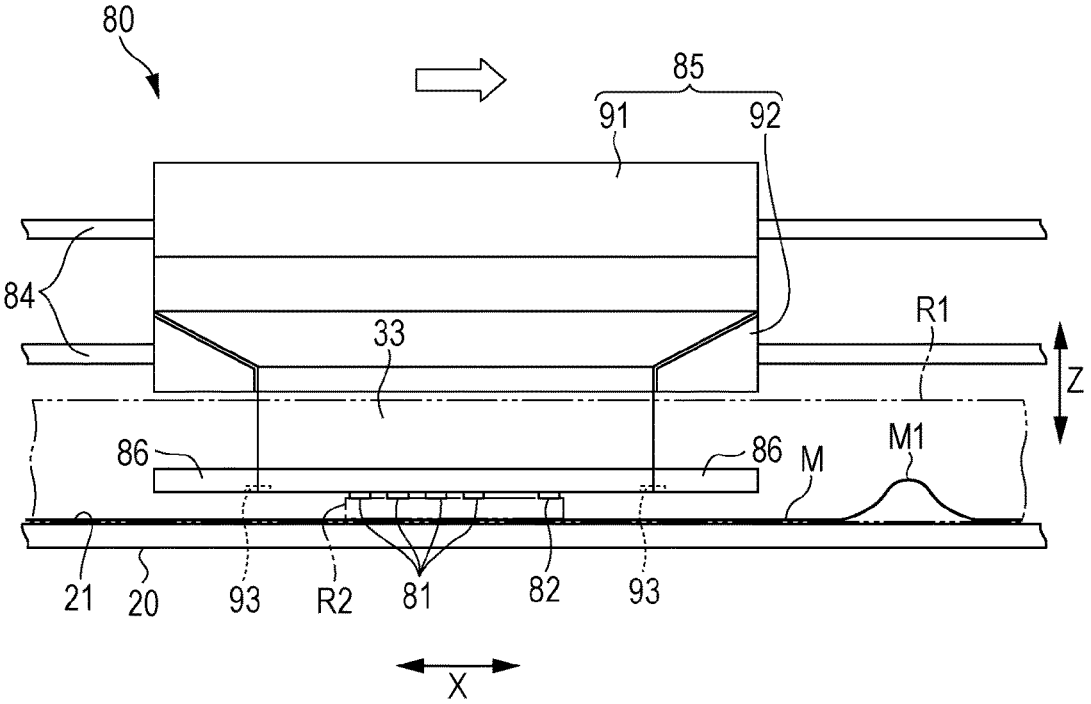

[Fig. 6A]
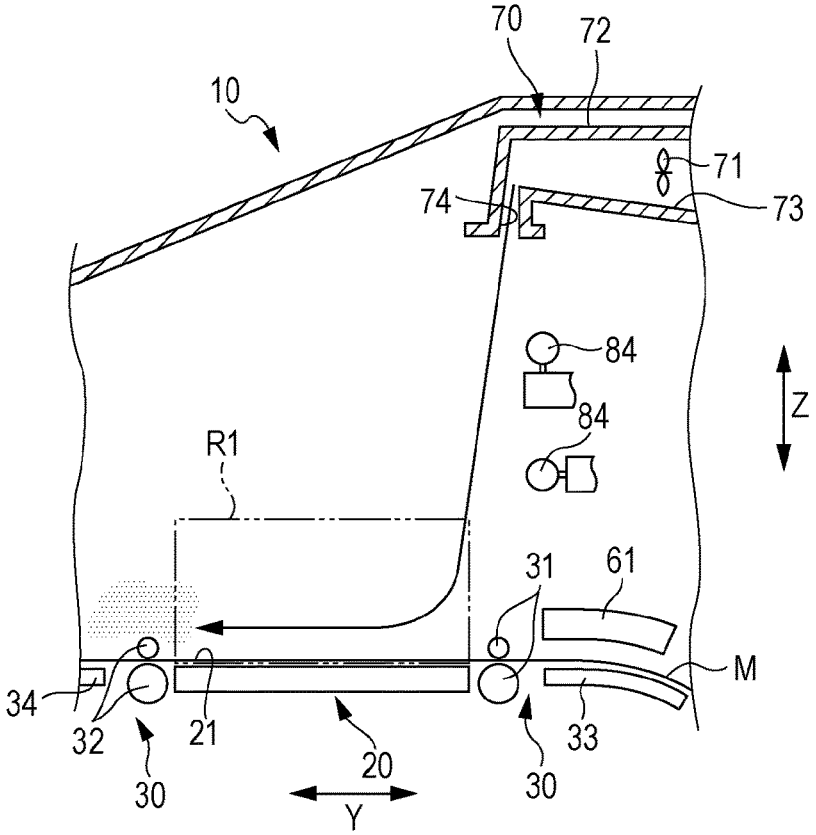
[Fig. 6B]
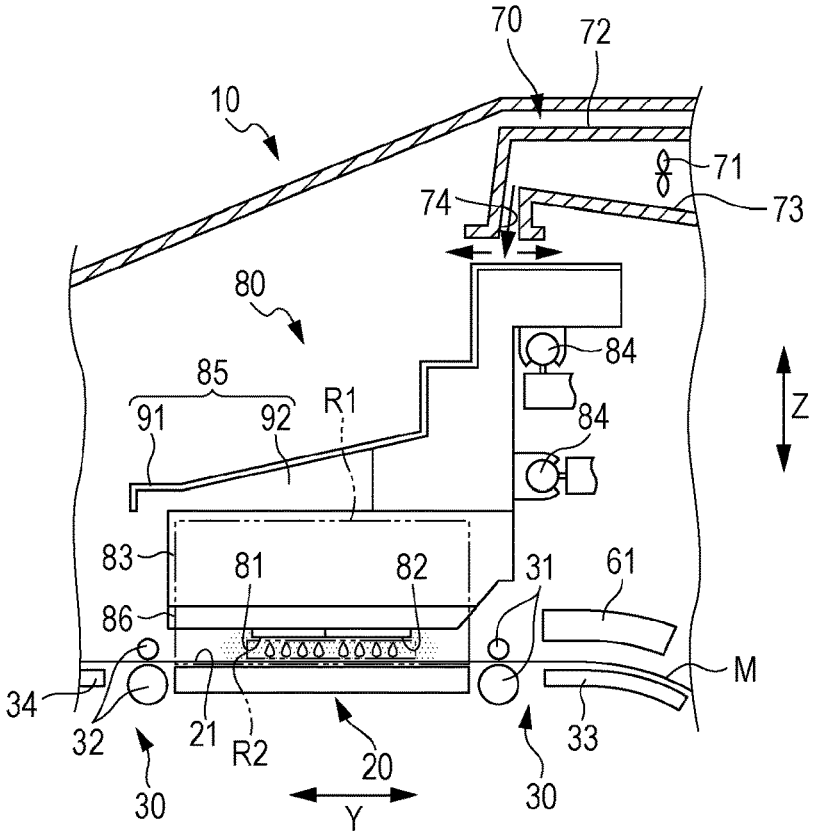

DROPLET DISCHARGING APPARATUS

TECHNICAL FIELD

The present invention relates to a droplet discharging apparatus such as an ink jet-type printer.

BACKGROUND ART

In the prior art, as an example of the droplet discharging apparatus, there is known an ink jet-type printer that prints a character or an image by discharging ink as an example of a droplet on a medium such as paper.

Such a printer includes a printer that includes a droplet discharging head for ink that discharges ink, and a droplet discharging head for process liquid that discharges process liquid that promotes curing of ink, and that aims for improvement in fixity and water resistance of ink on a medium by reacting with the ink and the process liquid on the medium (for example, PTL 1).

CITATION LIST

Patent Literature

PTL 1: JP-A-2007-216495

SUMMARY OF INVENTION

Technical Problem

Meanwhile, in the printer, mist of process liquid is generated when discharging the process liquid from a droplet discharging head that discharges the process liquid, or ink mist is generated when discharging ink from a droplet discharging head for ink.

In this case, if the mist of the process liquid is stuck to the droplet discharging head for ink, or the ink mist is stuck to the droplet discharging head for process liquid, the ink, and the process liquid react with each other in the droplet discharging head. That is, in the droplet discharging head, there is a concern that the ink is cured, and thereby a discharge defect of the ink or the process liquid is generated in the droplet discharging head.

In addition, such a situation is not limited to an ink jet-type printer that discharges ink and process liquid, and is also generally common in a droplet discharging apparatus that discharges first liquid, and second liquid that reacts with the first liquid.

In the invention, such a situation is reflected. Accordingly, it is an object of the present invention to provide a droplet discharging apparatus that is capable of suppressing the reaction between first liquid and second liquid in a droplet discharging section that discharges the first liquid and the second liquid.

Solution to Problem

Hereinafter, the means for solving the problem and the operation effect thereof will be described.

In order to solve the problem, according to an aspect of the invention, there is provided a droplet discharging apparatus including a supporting section that has a supporting surface that supports a medium, a droplet discharging section that includes a first nozzle that discharges first liquid onto the medium supported by the supporting surface, and a second nozzle that discharges second liquid that promotes curing of the first liquid by reacting with the first liquid onto the medium supported by the supporting surface, a carriage that reciprocally travels in a first direction while holding the droplet discharging section, an airflow generating section that generates airflow in a second direction intersecting the first direction in an area between the droplet discharging section and the supporting surface in a discharging area facing the supporting surface, and a shielding section that shields the airflow in the discharging area.

According to the configuration, in the discharging area that is the area facing the supporting surface, airflow is generated in the second direction intersecting the first direction by the airflow generating section. For this reason, when the droplet discharging section discharges the first liquid and the second liquid, even if the mist of the first liquid and the second liquid are generated, such mists are removed from the discharging area by the airflow in the second direction.

In addition, with regard to the area between the droplet discharging section and the medium in the discharging area, the airflow in the second direction is shielded by the shielding section. For this reason, in the area between the droplet discharging section and the medium, the flowing of mist is suppressed in the second direction, and it is possible to suppress the mist of the first liquid becoming stuck to the second nozzle, or the mist of the second liquid becoming stuck to the first nozzle.

In the droplet discharging apparatus, it is preferable that the airflow generating section includes, in a direction intersecting the supporting surface, an outlet opposite to the supporting surface in the view from the carriage, and generates airflow in the second direction by making air sent from the outlet collide with the supporting surface, and the shielding section is provided in the carriage so as to be positioned between the outlet and the carriage.

For example, in the case where the airflow generating section generates airflow in the second direction along the supporting surface, in order to shield the airflow in the area between the droplet discharging section and the medium in the discharging area, it is required to arrange the configuration for shielding the airflow as close to the medium as possible.

With regard to this, in this configuration, airflow (impinging flow) toward the second direction is generated by the air sent from the outlet colliding with the supporting surface. For this reason, in the configuration, in order to shield the airflow in the area between the droplet discharging section and the medium in the discharging area, it is preferable that the flow of the air toward the supporting surface is blocked by the shielding section positioned between the outlet and the carriage. Moreover, since the shielding section is provided in the carriage, in accordance with the position of the carriage in the first direction, it is possible to change the position of shielding of the air sent from the outlet. Thereby, according to the configuration, it is possible to easily shield the flow of the air with regard to the area between the droplet discharging section and the medium in the discharging area.

In the droplet discharging apparatus, it is preferable that the shielding section is provided so as to extend from the carriage in the first direction.

In the case where the shielding section is not extended in the first direction, the area where the shielding section is capable of shielding the air sent toward the supporting surface is limited to the area overlapping the carriage covered by the shielding section in the discharging area. For this reason, in the case where the carriage travels in the first direction, the droplet discharging section passes the area in which the air sent toward the supporting surface is not shielded.

With regard to this, according to the configuration, the area where the shielding section is capable of shielding the air sent toward the supporting surface is the area overlapping the portion where the shielding section is extended from the carriage in the first direction, in addition to the area overlapping the carriage covered by the shielding section in the discharging area. For this reason, in the case where the carriage travels in the first direction, the droplet discharging section passes the area in which the air sent toward the supporting surface is shielded.

Therefore, it is possible that the droplet discharging section further decreases the airflow in the area facing the droplet discharging section compared to the case where the shielding section is not extended in the first direction. In addition, by this airflow, it is possible to suppress the mist of the first liquid becoming stuck to the second nozzle, or the mist of the second liquid becoming stuck to the first nozzle.

In the droplet discharging apparatus, it is preferable that the droplet discharging section discharges the first liquid onto the medium on which the second liquid is discharged.

The second liquid has an effect of suppressing coagulation (combination) between droplets of the first liquid discharged at the position close to the medium, in promoting curing of the first liquid. For this reason, in the case of discharging the second liquid onto the medium on which the first liquid is discharged, if time from discharge of the first liquid to discharge of the second liquid becomes long, there is a case where the droplets of the first liquid discharged at the close position coagulate with each other. In this respect, according to the configuration, since the first liquid is discharged onto the medium on which the second liquid is discharged, it is possible to cure a droplet of the first liquid discharged on the medium while suppressing coagulation of the droplet of the first liquid with another droplet of the first liquid, without the limit of time.

In the droplet discharging apparatus, it is preferable that the droplet discharging section includes a concave portion provided at the supporting surface side, and at least any one of the first nozzle and the second nozzle is opened to the concave portion.

According to the configuration, since the nozzle opened to the concave portion is opened at the position recessed as much as the depth of the concave portion, it is difficult for mist generated to be stuck to a nozzle opened to the concave portion (for example, the first nozzle) when discharging a droplet from another nozzle (for example, the second nozzle). As a result, in the nozzle opened to the concave portion (for example, the first nozzle), it is possible to suppress the first liquid and the second liquid reacting and the first liquid being cured.

It is preferable that the carriage has an extending section extending in the first direction so as to face the supporting surface from the carriage.

When the carriage travels in the first direction, the droplet discharging section held in the carriage travels in the first direction with a gap from the medium. For this reason, in the area between the droplet discharging section (carriage) and the medium, there is a concern that airflow is generated along the first direction, which is the traveling direction of the carriage, and the mist of the first liquid is stuck to the second nozzle, or the mist of the second liquid is stuck to the first nozzle.

In this respect, in the configuration, since the extending section extending from the carriage in the first direction is formed, it is difficult for, when the carriage travels in the first direction, the airflow to be generated in the area between the droplet discharging section (carriage and extending section) and the medium. For this reason, in contrast to the traveling of the carriage in the first direction, it is possible to suppress the airflow being generated in the area between the droplet discharging section and the medium, the mist of the first liquid being stuck to the second nozzle, or the mist of the second liquid being stuck to the first nozzle.

It is preferable that the droplet discharging apparatus further includes a heating section that heats the medium at the upstream side in the transporting direction of the medium further than the droplet discharging section.

According to the configuration, since, before the droplet discharging section discharges the first liquid and the second liquid, it is possible to raise the temperature of the medium, if a droplet of any one of the first liquid and the second liquid is discharged, it is easy for a solvent component included in the one droplet to be dried on the medium before the other droplet is discharged.

For this reason, even in the case where the medium on which the one droplet (for example, the second liquid) is discharged comes in contact with the nozzle (for example, the first nozzle) that discharges the other droplet of the droplet discharging section, it is difficult for the one droplet to become stuck (transferred) to the nozzle from the medium. Therefore, according to the configuration, in the droplet discharging section, it is possible to suppress the first liquid and the second liquid reacting, and the first liquid being cured.

It is preferable that the droplet discharging apparatus further includes a detecting section that detects floating of the medium from the supporting surface, and, in the apparatus, traveling of the carriage stops in the case when the detecting section detects the floating of the medium when the carriage travels in the first direction.

If the carriage travels in the first direction while the medium floats from the supporting surface, there is a concern that the first liquid discharged onto the medium is stuck (transferred) to the second nozzle, or the second liquid discharged onto the medium is stuck (transferred) to the first nozzle, by the medium and the droplet discharging section coming into contact with each other. In this respect, according to the configuration, since the traveling of the carriage in the first direction is stopped if the detecting section detects the floating of the medium, it is possible to avoid such a situation.

It is preferable that the droplet discharging apparatus further includes a heating section that heats the medium at the downstream side in the transporting direction of the medium further than the droplet discharging section.

According to the above-described droplet discharging apparatus, it is possible to suppress the coagulation (combination) between the droplets of the first liquid discharged on the medium by the second liquid. For this reason, by heating the corresponding medium while discharging the first liquid on the medium, and evaporating the solvent composition included in the first liquid, the coagulation (combination) between the droplets of the first liquid discharged on the medium may not be suppressed.

According to the configuration, at the downstream side of the transporting direction further than the droplet discharging section, the medium on which the first liquid and the second liquid is heated, and the solvent composition included in the first liquid and the second liquid is evaporated. For this reason, since the heating section may not be provided in the vicinity of the droplet discharging section, it is possible to suppress the droplet discharging section being heated. That is, in the first nozzle and the second nozzle, it is possible to suppress thickening of liquid accompanying the evaporation of the solvent composition of the first liquid and the second liquid.

BRIEF DESCRIPTION OF DRAWINGS

FIG. 1 is a side sectional view of a droplet discharging apparatus.

FIG. 2 is a schematic view of a droplet discharging unit.

FIG. 3 is a top view of the droplet discharging unit from which a shielding section is removed.

FIG. 4 is a partial schematic view of a first head viewed from the vertically downward direction.

FIG. 5 is a front view of the droplet discharging unit while operating a discharging pass.

FIG. 6A is a partial side view of the droplet discharging apparatus while operating the discharging pass, and illustrates a discharging area in which a carriage is not arranged.

FIG. 6B is a partial side view of the droplet discharging apparatus while operating the discharging pass, and illustrates a discharging area in which a carriage is arranged.

DESCRIPTION OF EMBODIMENTS

Hereinafter, one embodiment of the droplet discharging apparatus will be described with reference to the drawings. In addition, the droplet discharging apparatus is an ink jet-type, large format printer that prints a character or an image on a medium by discharging a droplet onto the lengthy medium.

As illustrated in FIG. 1, a droplet discharging apparatus 10 includes a supporting section 20 that supports a medium M, a transporting section 30 that transports the medium M, a delivering section 40 and a winding section 50 that feed and wind the medium M, a first heating section 61 and a second heating section 62 that heat the medium M, an air sending section 70 that sends air inside a housing 11, and a droplet discharging unit 80 that discharges a droplet onto the medium M.

In the following description, a direction intersecting paper surface in FIG. 1 will be referred to as a "width direction X (refer to FIG. 2)", a direction that is the horizontal direction in FIG. 1, and intersects (is orthogonal) the width direction X will be referred to as a "front/rear direction Y", and a direction that is the vertical direction in FIG. 1, and intersects (is orthogonal) the width direction X and both directions of the front/rear direction Y will be referred to as a "perpendicular direction Z". In addition, the traveling direction of the medium M from the delivering section 40 to the winding section 50 will be referred to as a "transporting direction", and an upstream side or a downstream side will be described based on the transporting direction.

The supporting section 20 is in a rectangular shape in which the width direction X is the longitudinal direction. In addition, the supporting section 20 is configured of a supporting surface 21 in which a surface at the droplet discharging unit 80 supports the medium M from the vertical downward direction. On the supporting surface 21, for example, in order to suppress floating of the medium M, a vacuum hole that adsorbs the medium M may be formed.

The transporting section 30 includes a first pair of transporting rollers 31 arranged at the upstream side of the supporting section 20, and a second pair of transporting rollers 32 arranged at the downstream side of the supporting section 20. The pairs of transporting rollers 31 and 32 include a driving roller that grants transporting force to the medium M, and a subordinate driving roller that subordinately rotates by coming in contact with the medium M being transported. In addition, the transporting section 30 transports the medium M toward the downstream side by driving the driving roller while pinching the medium M between the pairs of transporting rollers 31 and 32.

Moreover, the transporting section 30 includes a first guiding section 33 arranged at the upstream side of the first pair of transporting rollers 31, and a second guiding section 34 arranged at the downstream side of the second pair of transporting rollers 32. The first guiding section 33 configures a part of a feeding port 12 that the medium M passes when being transported to the inside the housing 11. In addition, the second guiding section 34 configures a part of an outlet 13 that the medium M passes when being transported to the outside the housing 11.

In addition, the first guiding section 33 guides the medium M delivered out from the delivering section 40 to the first pair of transporting rollers 31 while supporting the medium M from the vertically downward direction. In addition, the second guiding section 34 guides the medium M transported from the second pair of transporting rollers 32 to the winding section 50 while supporting the medium M from the vertically downward direction.

The delivering section 40 includes a delivering axis 41 on which the lengthy medium M is wound. In addition, the delivering section 40 delivers the medium M toward the downstream side by rotating the delivering axis 41 in the counter-clockwise direction in FIG. 1. Moreover, the winding section 50 includes a winding axis 51 that winds the lengthy medium M. In addition, the winding section 50 winds the medium M by rotating the winding axis 51 in the counter-clockwise direction in FIG. 1. Moreover, the delivering section 40 may wind the medium M, or the winding section 50 may deliver the medium M toward the upstream side.

The first heating section 61 is, in the inside of the housing 11, provided in an area facing the first guiding section 33. In addition, the first heating section 61 heats the medium M transported above the first guiding section 33. Moreover, the second heating section 62 is, in the inside of the housing 11, provided in an area facing the second guiding section 34. In addition, the second heating section 62 heats the medium M transported above the second guiding section 34.

In this respect, according to the embodiment, the first heating section 61 corresponds to an example of "the heating section at the upstream side further than the droplet discharging section", and the second heating section 62 corresponds to an example of "the heating section at the downstream side further than the droplet discharging section". In addition, the first heating section 61 and the second heating section 62 may be equipped in the first guiding section 33 and the second guiding section 34.

The air sending section 70 includes a fan 71 that generates airflow, and a duct 72 in which air is ventilated. In the duct 72, an inlet 73 connected to the outside of the housing 11 and an outlet 74 connected to the inside of the housing 11 are provided. The fan 71 may be a blower fan, or a suction fan. The outlet 74 of the duct 72 is configured so that the air blown from the outlet 74 is directed to the front in proportion to being directed to the vertically downward direction.

In addition, the air sending section 70 sends air toward the supporting surface 21 inside the housing 11 through the outlet 74 by driving the fan 71. The air sent toward the supporting surface 21 colliding with the supporting surface 21, and thereby airflow (impinging flow) toward the front along the supporting surface 21 is generated. In this respect, according to the embodiment, the air sending section 70 corresponds to an example of "the airflow generating section", and the front in the front/rear direction Y along the supporting surface 21 corresponds to an example of "the second direction".

As illustrated in FIG. 1, the droplet discharging unit 80 includes a first head 81 that discharges the first liquid which is cured accompanied with the evaporation of a solvent, and a second head 82 that discharges the second liquid that promotes the curing of the first liquid by reacting with the first liquid. In addition, as illustrated in FIGS. 1 and 2, the droplet discharging unit 80 includes a carriage 83 that holds the first head 81 and the second head 82, a guide axis 84 that supports the carriage 83, a shielding section 85 that covers the upper portion of the carriage 83, and an extending section 86 extending to both sides of the width direction X from the lower portion (bottom) of the carriage 83.

As illustrated in FIG. 3, in a plurality of the first heads 81, a plurality of first nozzles 87 that discharge the first liquid are formed, and, in the second head 82, a plurality of second nozzles 88 that discharge the second liquid are formed. In this respect, according to the embodiment, the first head 81 and the second head 82 correspond to an example of "the droplet discharging section". In addition, the plurality of the first heads 81 discharge various types of the first liquid. That is, in a printer as an example of the droplet discharging apparatus 10, ink of various colors is discharged.

In addition, as illustrated in FIG. 3, in the first head 81, a nozzle array is formed by a plurality of the first nozzles 87, and, in the second head 82, a nozzle array is formed by a plurality of the second nozzles 88. Moreover, as illustrated in FIG. 4, in the first head 81, a concave portion 89 is provided at the supporting surface 21 side of the first head 81, and the first nozzle 87 is opened to the concave portion 89.

In addition, at the lower side (bottom) of the carriage 83, the first head 81 and the second head 82 are held with the first nozzle 87 and the second nozzle 88 facing the supporting surface 21. Here, as illustrated in FIG. 3, the plurality of the first heads 81 are arranged at the downstream side in the transporting direction further than the second head 82. For this reason, according to the embodiment, on the medium M on which the second liquid is discharged by the second head 82, the first head 81 discharges the first liquid. In addition, in the plurality of the first heads 81 and the second head 82, the first liquid and the second liquid are provided from different liquid housing portions not illustrated.

In addition, according to the embodiment, the carriage 83 is positioned between the supporting surface 21 and the outlet 74 in a direction (perpendicular direction Z) intersecting (orthogonal) the supporting surface 21. In other words, the outlet 74 is provided at the opposing side to the supporting surface 21 viewed from the carriage 83 in the intersecting direction.

In addition, the carriage 83 reciprocally travels in the width direction X as an example of the first direction while being supported by the guide axis 84 by driving of a motor not illustrated. Moreover, from the first head 81 and the second head 82 held in the carriage 83 that reciprocally travels in the width direction X, the first liquid and the second liquid are discharged toward the medium M supported by the supporting surface 21.

In addition, in the following description, an area facing the supporting surface 21 will be referred to as a "discharging area R1". Here, the discharging area R1 includes an area in which the first liquid and the second liquid discharged from the first head 81 and the second head 82 fly, and is an area where mist of the first liquid and the second liquid floats.

As illustrated in FIGS. 1 and 2, the shielding section 85 includes a first shielding plate 91 that shields air sent toward the discharging area R1 from the outlet 74, and a second shielding plate 92 that shields air generated in the width direction X by the carriage 83 traveling in the width direction X.

The first shielding plate 91 is extended at the width direction X side of the carriage 83 and at the front of the carriage 83 while covering the entire area in the width direction X of the vertically upper portion of the carriage 83. For this reason, as illustrated in FIG. 1, the first shielding plate 91 is positioned between the carriage 83 and the outlet 74 of the air sending section 70 in the perpendicular direction.

In addition, as illustrated in FIG. 2, the length of the first shielding plate 91 in the width direction X is short in a plan view from the rear to the front. Moreover, the first shielding plate 91 and the second shielding plate 92 may, for example, be formed by folding a plate that has elasticity such as metal. In addition, the first shielding plate 91 may, for example, be mounted at a fastening member such as a bolt or a nut with regard to the carriage 83.

As illustrated in FIGS. 2 and 3, the extending section 86 has a plate shape which can face the supporting surface 21. In addition, it is preferable that the gap in the perpendicular direction Z between the extending section 86 and the supporting surface 21 is short, and, for example, may be the same as the gap in the perpendicular direction Z between the first head 81 and the second head 82, and the supporting surface 21, or may be less than the corresponding gap.

In addition, as illustrated in FIG. 3, the length of the extending section 86 in the width direction X is short in a plan view from the rear to the front. For this reason, as illustrated in FIG. 2, a plan shape in both sides of the width direction X of the first shielding plate 91 and a plan shape in both sides of the width direction X of the extending section 86 are approximately the same.

As illustrated in FIG. 3, at the side (lower side) facing the supporting surface 21 of the extending section 86, a detecting section 93 that detects floating of the medium M from the supporting surface 21 is attached. The detecting section 93 is, for example, a reflection-type optical sensor that has a light emitting portion and a light receiving portion, and detects the floating of the medium M based on the change of reflection strength of light applied toward the medium M.

In addition, the detecting section 93 is provided at both sides of the width direction X of the carriage 83 so as to detect the floating of the medium M in the case where the carriage 83 travels to one or the other side of the width direction X. In addition, it is possible to use the detecting section 93 for detecting dimensions in the width direction X of the medium M based on the change of the reflection strength.

Next, an example of the first liquid and the second liquid discharged from the first head 81 and the second head 82 will be described.

In a ink jet-type printer as an example of the droplet discharging apparatus 10, the first liquid corresponds to ink, and the second liquid corresponds to process liquid. Here, it is preferable that the ink contains color material, resin for forming a resin layer on the medium M, and solvent that dissolves the color material and the resin.

That is, when the ink is discharged onto the medium M as a droplet, the ink is cured by forming the resin layer accompanied with the evaporation of the solvent. However, since, in the case where evaporation speed of the solvent is slow, the droplets of the ink discharged at the close position are cured while being condensed (combined), there is a case where it is not possible to obtain a desired printing quality.

Meanwhile, the process liquid has characteristics of reacting with the ink by coming in contact with the ink, and of promoting the curing of the ink. For this reason, by discharging an ink droplet onto the medium M on which a droplet of the process liquid is discharged, even in the case where the evaporation speed of the solvent of the ink is slow, it is possible to cure the ink quickly.

That is, after discharging the droplet of the process liquid so that the droplet is scattered on the medium M, the ink droplet is discharged between the droplet of the process liquid and a droplet of another process liquid. The ink droplet discharged onto the medium M comes in contact with the droplet of the process liquid discharged in the periphery thereof, and it is possible to suppress the ink droplet further expanding on the medium M. As a result, it is possible to suppress the droplets of the ink discharged at the close position being condensed (combined), and it is possible to obtain a desired printing quality. In addition, it is preferable that the process liquid is transparent so as to not affect the printing quality.

Thereby, in the droplet discharging apparatus 10 according to the embodiment, on the medium M onto which the second liquid, which promotes the curing of the first liquid by reacting to the first liquid, is discharged, it is possible to suppress the first liquid being discharged and the droplet of the first liquid being condensed on the medium M.

With reference to the FIGS. 5 and 6A and 6B, the application of the droplet discharging apparatus 10 of this embodiment will be described. In addition, a hatching area of a dot in FIGS. 6A and 6B means mist of the first liquid and the second liquid.

In the droplet discharging apparatus 10, in the case where a droplet is discharged onto the medium M, as illustrated in FIG. 1, the medium M delivered from the delivering section 40 is transported on the supporting surface 21 of the supporting section 20 while being heated at the first heating section 61. In addition, while the carriage 83 is driven at one side of the width direction X, a "discharging pass" in which a droplet is discharged onto the medium M from the first head 81 and the second head 82.

Here, since the first head 81 is provided at the downstream side further than the second head 82, the first head 81 discharges the first liquid in a discharging pass of the present time (N+1 discharging passes) onto the medium M on which the second head 82 has discharged the second liquid in a discharging pass of the previous time (Nth discharging pass). That is, according to the embodiment, in a certain discharging pass, the second liquid is discharged in an area at the upstream side of the medium M supported by the supporting surface 21, and the first liquid is discharged at an area at the downstream side further than the corresponding area. Here, by the curing of the first liquid by the second liquid discharged onto the medium M, it is possible to suppress a plurality of droplets of the first liquid discharged at the close position being condensed with each other.

Moreover, according to the embodiment, since, by the first heating section 61, the temperature of the medium M on the supporting surface 21 is set to be high, it is easy for the solvent composition included in the first liquid and the second liquid discharged onto the medium M to be evaporated. For this reason, even when the medium M on which the second liquid is discharged comes in contact with the first head 81 (first nozzle 87), it is possible to suppress the second liquid being transferred (stuck) to the first head 81 from the medium M. In addition, in that the solvent composition included in the first liquid is easy to be decreased in amount, it is difficult for the first liquid discharged onto the medium M to expand, and the effect of suppressing the condensation of the droplet of the first liquid is further increased.

Moreover, in the discharging pass, when the first liquid is discharged from the first head 81, there is a case where mist of the first liquid is generated, and, when the second liquid is discharged from the second head 82, there is a case where mist of the second liquid is generated. Here, the particle size of such mist is smaller than that of the droplets discharged from the first head 81 and the second head 82, and the mist drifts in the discharging area R1 (inside the housing 11).

In addition, if the mist of the second liquid is stuck to the first nozzle 87 of the first head 81, or the mist of the first liquid is stuck to the second nozzle 88 of the second head 82, there is a concern that, in the first nozzle 87 and the second nozzle 88, the first liquid is cured, and thereby a discharging defect of a droplet is generated in the first nozzle 87 and the second nozzle 88.

First, as illustrated in FIG. 5, in the discharging pass, by the traveling of the carriage 83 in the width direction X, there is a case where the airflow toward the width direction X is generated in an area R2 between the first head 81 and the second head 82 held in the carriage 83, and the medium M. In addition, by the airflow in the width direction X, there is a concern that the mist of the second liquid becomes stuck to the first nozzle 87 of the first head 81, or the mist of the first liquid becomes stuck to the second nozzle 88 of the second head 82.

In this respect, according to the embodiment, since the extending section 86 is provided so as to be extended in the width direction X at the vertically downward portion of the carriage 83, the flow resistance of the air in the area R2 between the first head 81 and the second head 82, and the medium M is higher than in the case where the extending section 86 is not provided. For this reason, it is difficult for the airflow toward the width direction X to be generated in the area R2 between the first head 81 and the second head 82, and the medium M.

Thereby, in the discharging pass, in the area R2 between the first head 81 and the second head 82 and the medium M, it is possible to suppress the mist of the second liquid being stuck to the first nozzle 87 of the first head 81, or the mist of the first liquid being stuck to the second nozzle 88 of the second head 82.

In addition, as illustrated in FIG. 5, when the carriage 83 travels in the width direction X, in the case where the medium M is floated from the supporting surface 21, the extending section 86 presses, by slidingly coming in contact with a portion M1, which is the floating portion, the portion M1 to the supporting surface 21. For this reason, it is possible to suppress the portion M1 floated from the medium M from coming into contact with the first head 81 and the second head 82.

Moreover, in the case where the height of the portion M1 floated from the medium M from the supporting surface 21 is smaller than a distance between the supporting surface 21 and the extending section 86, the floated portion M1 goes under the extending section 86 in the vertically downward direction thereof, and comes in contact with the first head 81 and the second head 82. In this respect, according to the embodiment, it is possible to detect the floating portion M1 by the detecting section 93 provided in the extending section 86.

In addition, in the case where the detecting section 93 detects floating of the medium M, the traveling of the carriage 83 in the width direction X is stopped, and thereby it is possible to suppress the portion M1 floated from the medium M from coming into contact with the first head 81 and the second head 82. In addition, after the traveling of the carriage 83 in the width direction X is stopped, for example, the pairs of transporting rollers 31 and 32 are driven in the direction opposite to the direction of transporting the medium M in the transporting direction, and thereby the floating of the medium M on the supporting surface 21 may be corrected.

Moreover, if the discharging pass is continued repeatedly, the mist of the first liquid and the second liquid floating inside the housing 11 gradually expands, and thereby there is a serious concern that the mist of the second liquid is stuck to the first nozzle 87 of the first head 81, or the mist of the first liquid is stuck to the second nozzle 88 of the second head 82.

In this respect, as illustrated in FIGS. 6A and 6B, according to the embodiment, air is sent toward the supporting surface 21 from the air sending section 70. For this reason, as illustrated by a solid-line arrow in FIG. 6A, of the discharging area R1, in an area where the carriage 83 is not arranged, the air sent toward the supporting surface 21 from the outlet 74 of the duct 72 collides with the supporting surface 21, and thereby the impinging flow (airflow) advancing in the direction along the supporting surface 21 is generated. That is, as illustrated in FIG. 6A, by the airflow toward the front along the supporting surface 21, the mist generated in the discharging area R1 is exhausted to the outside of the housing 11 through the outlet 13 (refer to FIG. 1).

Thereby, even in the case where the discharging of a droplet is continued, it is possible to suppress the expansion of the amount of the mist floating inside the housing 11.

Meanwhile, as illustrated in FIG. 6B, of the discharging area R1, in an area where the carriage 83 is arranged, the air sent toward the supporting surface 21 from the outlet 74 of the duct 72 is shielded by the shielding section 85 (first shielding plate 91) of the carriage 83, and thereby it is possible to suppress the air colliding with the supporting surface 21. That is, in the discharging area R1, in an area where the carriage 83 is arranged, it is difficult for the air sent toward the supporting surface 21 from the outlet 74 of the duct 72 to collide with the supporting surface 21, and due to that the impinging flow (airflow) advancing in the direction along the supporting surface 21 is generated.

For this reason, it is possible to suppress the generation of the airflow toward the front in the area R2 between the first head 81 and the second head 82 held in the carriage 83, and the medium M. Thereby, in the area R2 between the first head 81 and the second head 82 and the medium M, it is possible to suppress the mist of the second liquid being stuck to the first nozzle 87 of the first head 81, or the mist of the first liquid being stuck to the second nozzle 88 of the second head 82.

As described above, while the mist of the first liquid and the mist of the second liquid is exhausted from the inside of the housing 11 so as not to be stuck to the first head 81 and the second head 82, the discharging pass is performed. In addition, if the discharging pass is performed one time, the medium M is transported by a predetermined amount in the transporting direction. Thereby, the medium M, onto which the first liquid and the second liquid is discharged on the supporting surface 21, is heated by the second heating section 62 while being transported to the second guiding section 34. The solvent composition included in the first liquid and the second liquid is evaporated, and the first liquid is bonded to the medium M more securely. In addition, the dried medium M is wound by the winding section 50.

According to the above-described embodiment, the following effects can be obtained.

(1) The airflow toward the front is generated in the discharging area R1, and thereby it is possible to exhaust the mist generated when discharging a droplet from the first head 81 and the second head 82 from the discharging area R1. In addition, with regard to the area R2 between the first head 81 and the second head 82 in the discharging area R1 and the medium, the airflow in the second direction is shielded by the shielding section 85. For this reason, it is possible to suppress flow of the mist in the area R2, and to suppress the mist of the first liquid being stuck to the second nozzle 88, or the mist of the second liquid being stuck to the first nozzle 87. Thereby, it is possible to suppress the discharging defect of the first liquid in the first head 81 and the discharging defect of the second liquid in the second head 82. In addition, by the airflow, it is possible to remove not only the mist of the first liquid and the second liquid but also refuse, fluff, and paper dust.

(2) For example, in the case where airflow is generated at the front along the supporting surface 21, in order to shield the airflow in the area R2 between the first head 81 and the second head 82 in the discharging area R1 and the medium, it is required to arrange the configuration for shielding the airflow as close to the medium M as possible.

With regard to this, according to the embodiment, by the impinging flow generated by the air sent toward the supporting surface 21 from the vertically upward direction of a traveling area of the carriage 83 colliding with the supporting surface 21, the airflow toward the front is generated. For this reason, in this case, in order to shield the airflow along the surface of the medium M in the area R2 between the first head 81 and the second head 82 in the discharging area R1 and the medium M, the flow of the air toward the supporting surface 21 may be shielded by the shielding section 85 that covers the vertically upward direction of the carriage 83. Thereby, according to the configuration, it is possible to easily shield the flow of the air with regard to the area R2 between the first head 81 and the second head 82 in the discharging area R1 and the medium M.

(3) The shielding section 85 is capable of shielding the air sent toward the supporting surface 21 by the shielding section 85 extending in the width direction X in the area overlapping the portion where the shielding section 85 is extended from the carriage 83 in the width direction X, in addition to the area overlapping the carriage 83 covered by the shielding section 85. For this reason, in the case where the carriage 83 travels in the width direction X, the first head 81 and the second head 82 pass the area in which the air sent toward the supporting surface 21 is shielded. For this reason, it is possible that the droplet discharging section further decreases the airflow in the area facing the droplet discharging section compared to the case where the shielding section 85 is not extended in the width direction X, and passes the area where the air sent toward the supporting surface 21 is not shielded. As a result, it is possible to suppress the mist of the first liquid being stuck to the second nozzle 88, or the mist of the second liquid being stuck to the first nozzle 87.

(4) The second head 82 is arranged at the upstream direction further than the first head 81, and thereby the first liquid is discharged onto the medium M on which the second liquid is discharged. For this reason, not being limited to time from discharging the second liquid to discharging the first liquid, it is possible to cure the first liquid at a certain position of the medium M on which the first liquid is discharged.

(5) The first nozzle 87 is opened to the concave portion 89 provided in the first head 81, and thereby it is difficult for the mist generated when the second liquid is discharged from the second nozzle 88 to become stuck to the first nozzle 87 opened to the concave portion 89. Thereby, in the first nozzle 87 opened to the concave portion 89, it is possible to suppress the first liquid and the second liquid reacting and the first liquid being cured.

(6) Since the extending section 86 is extended in the width direction X from the carriage 83, when the carriage 83 travels in the width direction X, the flow resistance of the air in the area R2 between the first head 81 and the second head 82 (carriage 83), and the medium M is high. For this reason, even in the case where the carriage 83 travels in the width direction X, it is difficult for the airflow along the width direction X between the first head 81 and the second head 82, and the medium M to be generated, and it is possible to relieve the concern that the mist of the first liquid is stuck to the second nozzle 88, or the mist of the second liquid is stuck to the first nozzle 87.

(7) Since, before the first head 81 and the second head 82 discharge the first liquid and the second liquid onto the medium M, it is possible to raise the temperature of the medium, if a droplet of the second liquid is discharged, it is easy for the solvent component included in the droplet of the second liquid to be evaporated on the medium M before the droplet of the first liquid is discharged. For this reason, even when the medium M on which the droplet of the second liquid is discharged comes in contact with the first nozzle 87 of the first head 81, it is possible to make the droplet unlikely to be transferred (stuck) to the first nozzle 87 from the medium M.

(8) In the case where the detecting section 93 detects floating of the medium M, the traveling of the carriage 83 in the width direction X is stopped. Thereby, when the carriage 83 travels in the width direction X, it is possible to avoid a situation where the first head 81 and the second head 82 and the medium M floated from the supporting surface 21 come into contact with each other.

(9) Since it is possible to suppress the condensation (combination) of the droplets of the first liquid on the medium M by the second liquid according to the droplet discharging apparatus 10 as in the embodiment, the medium M may be heated while the first liquid is discharged onto the medium M, and the solvent composition included in the first liquid may not be evaporated. The second heating section 62 is provided at the downstream side of the transporting direction further than the first head 81 and the second head 82, the medium M on which the first liquid and the second liquid is discharged is heated, and the solvent composition included in the first liquid and the second liquid is evaporated.

For this reason, since the heating section may not be provided in the vicinity of the first head 81 and the second head 82, it is possible to suppress the first head 81 and the second head 82 being heated. As a result, it is possible to suppress nozzle clogging accompanied with the evaporation of the solvent composition of the first liquid and the second liquid in the first nozzle 87 and the second nozzle 88.

In addition, the embodiment may be modified as follows.

For this reason, by the shielding section 85 covering the vertically upward portion of the carriage 83, in the discharging area R1, the generation of the airflow toward the front in the area R2 between the first head 81 and the second head 82, and the medium M is suppressed. However, the generation of the airflow may not be suppressed. For example, the outlet 74 of the duct 72 may be provided in a state where a blocking plate thereof that can be blocked is divided in the width direction X so that the blocking plate can be individually controlled in being blocked. In addition, in accordance with the position of the carriage 83 toward the width direction X, a blocking plate overlapped with the carriage 83 (first head 81 and second head 82) may be blocked in the width direction X so that the airflow is not generated in the area R2 between the first head 81 and the second head 82, and the medium M.

With regard to the extending section 86, a through hole may be formed in the perpendicular direction Z. In this case, when the carriage 83 travels in the width direction X, the air flowing between the extending section 86 and the medium M flows in the vertical upward direction of the extending section 86 through the through hole. For this reason, when the carriage 83 travels in the width direction X, it is possible to suppress the generation of the airflow toward the first direction in the area R2 between the first head 81 and the second head 82, and the medium M.

The first head 81 may be provided at the upstream side further than the second head 82. That is, the second liquid may be discharged on the medium M on which the first liquid is discharged.

The first nozzle 87 and the second nozzle 88 may be formed in a single droplet discharging head. In this case, the first liquid and the second liquid may or may not be discharged toward the medium M at approximately the same time.

The first heating section 61 and the second heating section 62 may not be provided.

The second nozzle 88 may be formed in the second head 82 so as to be opened to the concave portion 89. In addition, the first nozzle 87 may not be opened to the concave portion 89.

The air sending section 70 may send air from the front (outlet 13) toward the rear (feeding port 12), or send air from the rear (feeding port 12) toward the front (outlet 13).

The material of the medium M may be resin, metal, fabric, or paper.

The droplet discharging apparatus 10 may be a serial printer, a line printer, or a page printer.

Hereinafter, the ink (coloring ink) as the first liquid will be described.

The ink used in the droplet discharging apparatus 10 compositionally contains resin, and does not practically contain glycerin, of which the boiling point is 290° C. under one atmospheric pressure. If the ink practically contains glycerin, the drying characteristic of the ink is greatly lowered. As a result, in various media, specifically, in a medium that has ink-non absorbability or low absorbability, density unevenness of an image stands out, and also the fixity of the ink cannot be obtained. Moreover, it is preferable that the ink does not practically contain alkylpolyols (except for glycerin described above), of which the boiling point is 280° C. or more under 1 atmospheric pressure.

Here, the expression "does not practically contain" means not containing the chemical by the amount equal to or more than the amount where the consequence of addition of the chemical is sufficiently shown. To describe this in a quantitative manner, it is preferable that, with regard to the total mass (100 mass percent) of the ink, glycerin is contained not equal to or more than 1.0 mass percent, it is more preferable that glycerin is contained not equal to or more than 0.5 mass percent, it is further more preferable that glycerin is contained not equal to or more than 0.1 mass percent, it is further more preferable that glycerin is contained not equal to or more than 0.05 mass percent, and it is specifically further more preferable that glycerin is contained not equal to or more than 0.01 mass percent. In addition, it is the most preferable that glycerin is contained not equal to or more than 0.001 mass percent.

Next, an additive (component) that is contained or can be obtained in the ink will be described.

(1. Color Material)

The ink may contain color material. The color material is selected from pigments or dyes.

(1-1. Pigment)

By a pigment being used as color material, it is possible to improve light resistance of the ink. It is possible to use any of inorganic pigments or organic pigments. Inorganic pigments include, for example, although not specifically limited thereto, carbon black, iron oxide, titanium oxide, and oxidation silica.

Organic pigments include, for example, although not specifically limited thereto, a quinacridone-type pigment, a quinacridone quinone-type pigment, a dioxazine-based pigment, a phthalocyanine-type pigment, an anthrapyrimidine-type pigment, an anthanthrone-type pigment, an indanthrone-type pigment, a flavanthrone-type pigment, a perylene-type pigment, a diketopyrrolopyrrole-type pigment, a perinone-type pigment, a quinophthalone-type pigment, an anthraquinone-type pigment, a thioindigo-type pigment, a benzimidazolone-type pigment, an isoindolinone-type pigment, an azo methine-type pigment, and an azo-type pigment. A specific example of organic pigments includes the following.

Pigments used as cyan ink include C.I. Pigment Blue 1, 2, 3, 15, 15:1, 15:2, 15:3, 15:4, 15:6, 15:34, 16, 18, 22, 60, 65, and 66, and C.I. Bat Blue 4 and 60. Of the pigments, it is preferable to use C.I. Pigment Blue 15:3 or 15:4.

Pigments used as magenta ink include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, 245, 254, and 264, and C.I. Pigment Violet 19, 23, 32, 33, 36, 38, 43, and 50. Of the pigments, it is preferable to use one or more types selected from the group of C.I. Pigment Red 122, C.I. Pigment Red 202, and C.I. Pigment Violet 19.

Pigments used as yellow ink include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, and 213. Of the pigments, it is preferable to use one or more types selected from the group of C.I. Pigment Yellow 74, 155, and 213.

In addition, pigments used in color ink such as green ink or orange ink, which is not included in the above-described ink, include the pigments of the prior art.

It is preferable that the average particle diameter of the pigment is 250 nanometers or less, since it is possible to suppress clogging in a nozzle and discharging stability is further improved. In addition, the average particle diameter herein follows a volume standard. As a measuring method, for example, it is possible to measure by a grain size distribution measuring device, of which the measuring principle is the laser diffraction/scattering grain size distribution method. The grain size distribution measuring device includes, for example, a particle size analyzer of which the measuring principle is the dynamic light scattering method (microtrack UPA produced by, for example, Nikkiso Co, Ltd.).

(1-2. Dye)

It is possible to use a dye as color material. Usable dyes include, although not specifically limited thereto, an acid dye, a direct dye, a reactive dye, and a basic dye. It is preferable that the content of the color material is, with regard to the total mass of the ink (100 mass percent), 0.4 to 12 mass percent, and it is more preferable that the content of the color material is 2 to 5 mass percent.

(2. Resin)

The ink contains resin. By the ink containing resin, a resin film is formed on the medium. As a result, the ink is sufficiently fixed on the medium, and brings an effect of mainly improving abrasion resistance of an image. For this reason, it is preferable that the resin emersion is thermoplastic resin. It is preferable that the thermal deformation temperature of the resin is 40° C. or more, and it is more preferable that the thermal deformation temperature of the resin is 60° C. or more, since it is difficult for clogging to occur in a nozzle, and a favorable effect of making the medium having abrasion resistance can be obtained.

Here, "thermal deformation temperature" herein is a temperature value expressed by glass transition temperature (Tg) or minimum film forming temperature (MFT). That is, the expression of "the thermal deformation temperature is equal to or more than 40° C." means that it is preferable that any of Tg or MFT is equal to or more than 40° C. In addition, since it is easier to comprehend superiority or inferiority of redispersibility of the resin in MFT than in Tg, it is preferable that the thermal deformation temperature is a temperature value expressed by MFT. If the ink has superior resin redispersibility, it is difficult for a nozzle to be clogged since the ink is not fixed.

Specific examples of the thermoplastic resin include, although are not specifically limited thereto, poly (meth) acrylate or the copolymer thereof, polyacrylonitrile or the copolymer thereof, (meth)acrylic polymer such as polycyanoacrylate, polyacrylamide, and poly (meth)acrylic acid, and polyethylene, polypropylene, polybutene, polyisobutylene and polystyrene, and the copolymer thereof, polyolefin-based polymer such as oil resin, coumarone indene resin, and terpene resin, polyvinyl acetate or the copolymer thereof, vinyl acetate- or vinyl alcohol-based polymer such as polyvinyl alcohol, polyvinyl acetal, and polyvinyl ether, polyvinyl chloride or the copolymer thereof, halogen-containing polymer such as polyvinylidene chloride, fluoric resin and fluorine rubber, polyvinyl carbazole, polyvinylpyrrolidone, or the copolymer thereof, nitrogen-containing vinyl based polymer such as polyvinyl pyridine and polyvinyl imidazole, polybutadiene or the copolymer thereof, diene-based polymer such as polychloroprene and polyisoprene (isobutylene-isoprene rubber), and other ring-opening polymerization type resin, condensation-polymerization type resin, and natural macromolecule resin.

It is preferable that the content of the resin is, with regard to the total mass of the ink (100 mass percent), 1 to 30 mass percent, and it is more preferable that the content of the resin is 1 to 5 mass percent. If the content is within the scope, it is possible to obtain further superior glossiness and abrasion resistance of a finishing image to be formed. In addition, resin that may be contained in the ink includes, for example, a resin dispersant, resin emulsion, wax, or the like.

(2-1. Resin Emulsion)

The ink may contain resin emulsion. The resin emulsion forms a resin film preferably with wax (emulsion) when a medium is heated, and thereby brings the effect of improving abrasion-resistance of an image by fixing the ink on the medium. In the case where the medium is printed by ink containing the resin emulsion as a result, the ink is superior in abrasion-resistance particularly on a medium that has ink-non absorbability or low absorbability.

In addition, the resin emulsion that functions as a binder is contained in ink in an emulsion state. By the resin that functions as a binder being contained in ink in an emulsion state, it is easy to adjust the viscosity of the ink within an appropriate scope in an ink jet recording method, and, it is possible to improve preservation stability and discharging stability of the ink.

The resin emulsion includes, although not limited hereinafter, for example, the homopolymer or the copolymer of (meth)acrylic acid, (meth)acrylic ester, acrylonitrile, cyanoacrylate, acrylic amide, olefin, styrene, vinyl acetate, vinyl chloride, vinyl alcohol, vinyl ether, vinyl pyrrolidone, vinyl pyridine, vinyl carbazole, vinyl imidazole, and vinylidene chloride, fluororesin, and natural resin. Thereof, it is preferable to use any of methacrylic-based resin and styrene-methacrylic acid copolymer based resin, it is more preferable to use any of acrylic resin and styrene-methacrylic acid copolymer based resin, and it is further preferable to use styrene-methacrylic acid copolymer based resin. In addition, the copolymer may be in any state of a random copolymer, a block copolymer, an alternating copolymer, and a graft copolymer.

It is preferable that, in order to further improve preservation stability and discharging stability of the ink, the average particle diameter of the resin emulsion is 5 to 400 nanometers, and it is more preferable that the average particle diameter of the resin emulsion is 20 to 300 nanometers. It is preferable that the content of the resin emulsion in the resin is, with regard to the total mass of the ink (100 mass percent), 0.5 to 7 mass percent. If the content is within the scope, since it is possible to lower solid component concentration, it is possible to further improve discharging stability.

(2-2. Wax)

The ink may contain wax. By the ink containing wax, the fixity of the ink on the medium that has ink-non absorbability or low absorbability is further improved. It is preferable that the wax is an emulsion-type. The wax includes, although not limited hereinafter, for example, polyethylene wax, paraffin wax, and polyolefin wax, and it is preferable to use polyethylene wax described hereinafter. In addition, "wax" herein mainly means wax using a surfactant described hereinafter and solid wax particles dispersed in water.

By the ink containing polyethylene wax, it is possible to improve abrasion-resistance of the ink. It is preferable that, in order to further improve preservation stability and discharging stability of the ink, the average particle diameter of the polyethylene wax is 5 to 400 nanometers, and it is more preferable that the average particle diameter of the polyethylene wax is 50 to 200 nanometers.

It is preferable that the content of the polyethylene wax (converted to solid content) is, respectively, with regard to the total mass of the ink (100 mass percent), 0.1 to 3 mass percent, it is more preferable that the content of the polyethylene wax is 0.3 to 3 mass percent, and it is further preferable that the content of the polyethylene wax is 0.3 to 1.5 mass percent. If the content is in the scope, it is also possible to easily solidify and fix the ink on the medium that has ink-non absorbability or low absorbability, and to further improve preservation stability and discharging stability of the ink.

(3. Surfactant)

The ink may contain surfactant. The surfactant includes, although not limited hereinafter, for example, a nonion-type surfactant. Nonion-type surfactant has an effect of uniformly spreading the ink on the medium. For this reason, in the case where printing is performed by using the ink including nonion-type surfactant, it is possible to obtain a high-definition image with almost no stain. The nonion-type surfactant includes, although not limited hereinafter, for example, a silicon-based, a polyoxyethylene alkyl ether-based, a polyoxypropylene alkyl ether-based, a polycyclic phenyl ether-based, a sorbitan derivative, and a fluorine-based surfactant, and it is preferable to use the silicon-based surfactant.

It is preferable that the content of the surfactant is, in order to further improve preservation stability and discharging stability of the ink, with regard to the total mass of the ink (100 mass percent), 0.1 to 3 mass percent.

(4. Organic Solvent)

The ink may contain a known volatile or water-soluble organic solvent. However, as described above, it is preferable that the ink does not practically contain glycerin (of which the boiling point is 290° C. under 1 atmospheric pressure), which is a kind of organic solvent, and alkylpolyols (except for glycerin described above), of which the boiling point is 280° C. or more under 1 atmospheric pressure.

(5. Non-Proton Type Polar Solvent)

The ink may contain a non-proton type polar solvent. By the ink containing the non-proton type polar solvent, since the above-described resin particles contained in the ink are dissolved, it is possible to effectively suppress clogging in a nozzle when printing. In addition, since a non-proton type polar solvent has a characteristic of dissolving medium such as vinyl chloride, adhesion of an image is improved.

As the non-proton type polar solvent, although not specifically limited thereto, it is preferable to use one or more selected from a pyrrolidone type, a lactone type, a sulfoxide type, an imidazolidinone type, a sulfolane type, a urea derivative type, a dialkylamide type, a cyclicethers type, and an amideether type. The pyrrolidone type typically includes 2-pyrrolidone, N-methyl-2-pyrrolidone, and N-ethyl-2-pyrrolidone, the lactone type typically includes γ-butyrolactone, γ-valerolactone, and ε-mosquito professional lactone, and the sulfoxide type typically includes dimethyl sulfoxide and tetramethylene sulfoxide.

The imidazolidinone type typically includes 1,3-dimethyl-2-imidazolidinone, the sulfolane type typically includes sulfolane, dimethyl sulfolane, and the urea derivative typically includes dimethylurea and 1,1,3,3-tetramethyl urea. The dialkylamide type typically includes dimethylformamide and dimethyl acetamide, and the cyclicethers type typically includes 1,4-dioxane and tetrahydrofuran.

Thereof, for the above-described effect, it is preferable to use the pyrrolidone type, the lactone type, the sulfoxide type, and the amideether type, and it is most preferable to use 2-pyrrolidone. It is preferable that the content of the non-proton type polar solvent is, with regard to the total mass of the ink (100 mass percent), 3 to 30 mass percent, and it is more preferable that the content of the resin is 8 to 20 mass percent.

(6. Other Components)

The ink may further contain, in addition to the above component, a fungicide, an antirust agent, or a chelating agent.

It is preferable that the second liquid has a characteristic of promoting curing of thermoplastic resin contained in the ink. For example, in the case where acrylic polymers or polystyrene is used as resin included in the ink, it is preferable to use epichlorohydrin as the second liquid.

REFERENCE SIGNS LIST

10 Droplet discharging apparatus
21 Supporting surface
20 Supporting section
61 First heating section (example of heating section)
62 Second heating section (example of heating section)
70 Air sending section (example of airflow generating section)
81 First head (example of droplet discharging section)
82 Second head (example of droplet discharging section)
83 Carriage
85 Shielding section
86 Extending section
87 First nozzle
88 Second nozzle
89 Concave portion
93 Detecting section
M Medium
R1 Discharging area
X Width direction (example of first direction)
Y Front of front/rear direction (example of second direction)

The invention claimed is:

1. A droplet discharging apparatus comprising:

a supporting section that has a supporting surface that supports a medium;

a droplet discharging section that includes a first head, the first head including a first nozzle that discharges first liquid onto the medium supported by the supporting surface, and a second head, the second head including a second nozzle that discharges second liquid that promotes curing of the first liquid by reacting with the first liquid onto the medium supported by the supporting surface;

a carriage that reciprocally travels in a first direction while holding the droplet discharging section;

an airflow generating section that generates airflow in a second direction intersecting the first direction in a discharging area facing the supporting surface;

a shielding section that shields the airflow in the second direction in an area between the droplet discharging section and the supporting surface in the discharging area;

an extending section extending out from the carriage in the first direction to be opposed to the support surface; and a detecting section that detects floating of the medium from the supporting surface, the detecting section being disposed on a surface of the extending section facing the support surface, wherein the first head and the second head are arranged in the second direction and wherein the second head is arranged so as to be offset from the first head in the second direction.

2. The droplet discharging apparatus according to claim 1, wherein the airflow generating section includes, in a direction intersecting the supporting surface, an outlet opposite to the supporting surface in the view from the carriage, and generates airflow in the second direction by making air sent from the outlet collide with the supporting surface, and the shielding section is provided in the carriage so as to be positioned between the outlet and the carriage.

3. The droplet discharging apparatus according to claim 2, wherein the shielding section is provided so as to extend from the carriage in the first direction.

4. The droplet discharging apparatus according to claim 1, wherein the droplet discharging section discharges the first liquid onto the medium on which the second liquid is discharged.

5. The droplet discharging apparatus according to claim 1, wherein the droplet discharging section includes a concave portion provided at the supporting surface side, and at least any one of the first nozzle and the second nozzle is opened to the concave portion.

6. The droplet discharging apparatus according to claim 1, wherein the carriage has an extending section extending in the first direction so as to face the supporting surface from the carriage.

7. The droplet discharging apparatus according to claim 1, further comprising:

a heating section that heats the medium at the upstream side in the transporting direction of the medium further than the droplet discharging section.

8. The droplet discharging apparatus according to claim 1 wherein traveling of the carriage stops in the case when the detecting section detects the floating of the medium when the carriage travels in the first direction.

9. The droplet discharging apparatus according to claim 1, further comprising:

a heating section that heats the medium at the downstream side in the transporting direction of the medium further than the droplet discharging section.

10. The droplet discharging apparatus according to claim 1, wherein the shielding section overlaps a portion of the extending section.

* * * * *